US007246510B2

(12) United States Patent
Kim et al.

(10) Patent No.: US 7,246,510 B2
(45) Date of Patent: Jul. 24, 2007

(54) WASHING MACHINE

(75) Inventors: Jeong Seok Kim, Changwon-shi (KR); Yang Hwan No, Changwon-shi (KR); Han Ki Cho, Changwon-shi (KR); Yeon Su Jung, Changwon-shi (KR); Jung Hoon Kang, Changwon-shi (KR); Myung Sik Park, Changwon-shi (KR); Young Hoon Ha, Masan-shi (KR)

(73) Assignee: LG Electronics Inc., Seoul (KR)

( * ) Notice: Subject to any disclaimer, the term of this patent is extended or adjusted under 35 U.S.C. 154(b) by 698 days.

(21) Appl. No.: 10/471,651

(22) PCT Filed: Jan. 11, 2003

(86) PCT No.: PCT/KR03/00054

§ 371 (c)(1),
(2), (4) Date: Sep. 11, 2003

(87) PCT Pub. No.: WO03/057969

PCT Pub. Date: Jul. 17, 2003

(65) Prior Publication Data

US 2005/0011234 A1 Jan. 20, 2005

(30) Foreign Application Priority Data

| | | |
|---|---|---|
| Jan. 11, 2002 | (KR) | 10-2002-0001729 |
| Jul. 11, 2002 | (KR) | 10-2002-0040248 |
| Nov. 28, 2002 | (KR) | 10-2002-0074998 |
| Nov. 28, 2002 | (KR) | 10-2002-0075029 |
| Dec. 31, 2002 | (KR) | 10-2002-0087782 |

(51) Int. Cl.
*D06F 39/12* (2006.01)

(52) U.S. Cl. ..... 68/3 R; 68/142

(58) Field of Classification Search ..... 68/24, 68/58, 3 R, 140

See application file for complete search history.

(56) References Cited

U.S. PATENT DOCUMENTS 2,182,655 A * 12/1939 Bowen ..... 68/18 R
2,865,390 A * 12/1958 Bowen et al. ..... 137/188

(Continued)

FOREIGN PATENT DOCUMENTS

DE 27 03 035 * 7/1978

(Continued)

OTHER PUBLICATIONS

European Patent Office 0 278 239 Jan. 1988.*

(Continued)

*Primary Examiner*—Frankie L. Stinson
(74) *Attorney, Agent, or Firm*—McKenna Long & Aldridge

(57) ABSTRACT

Disclosed is a washing machine for preventing leakage of bubbles. The washing machine includes: a housing (10); a tube (20) installed inside the housing (10), for storing washing water, the tub (20) including at least one opening (21, 22, 23) and at least one pipe (21*b*,22*b*, 23*b*) connected with the opening (21, 22, 23); a drum (30) installed inside the tub (20) and configured to wash laundry; and cutoff means (100, 200, 300, 400) for preventing bubbles generated in the drub (30) and the tub (20) from being leaked to an outside through the opening (21, 22, 23) and the pipe (21*b*, 22*b*, 23*b*).

41 Claims, 17 Drawing Sheets

U.S. PATENT DOCUMENTS

| | | | | | |
|---|---|---|---|---|---|
| 2,961,863 | A | * | 11/1960 | Sulcek | 68/20 |
| 2,986,917 | A | * | 6/1961 | Smith | 68/20 |
| 3,070,984 | A | * | 1/1963 | Roy | 68/17 R |
| 3,762,866 | A | * | 10/1973 | Rayment et al. | 8/149.1 |
| 5,058,401 | A | * | 10/1991 | Nakamura et al. | 68/19.2 |
| 5,687,440 | A | * | 11/1997 | Min et al. | 8/158 |

FOREIGN PATENT DOCUMENTS

| | | | | |
|---|---|---|---|---|
| EP | 0 390 343 | A2 | | 10/1990 |
| JP | 52-099661 | | | 8/1977 |
| JP | 56-106178 | | | 8/1981 |
| JP | 59-095991 | | | 6/1984 |
| JP | 59-120197 | | | 7/1984 |
| JP | 59118195 | | | 7/1984 |
| JP | 59120197 | | | 7/1984 |
| JP | 59-119287 | | | 8/1984 |
| JP | 61-10-6572 | | | 7/1986 |
| JP | 3-66396 | | * | 3/1991 |
| JP | 3178691 | A | | 8/1991 |
| JP | 03-092480 | | | 9/1991 |
| JP | 3-228796 | | * | 10/1991 |
| JP | 04-352998 | | | 12/1992 |
| JP | 09-042498 | | | 2/1997 |
| JP | 10-33878 | | * | 2/1998 |
| JP | 10-272277 | | | 10/1998 |
| JP | 10-288391 | | | 10/1998 |
| JP | 2001-059578 | | | 3/2001 |
| JP | 2001-300179 | | | 10/2001 |
| KR | 97059368 | | * | 8/1997 |

OTHER PUBLICATIONS

International Search Report; Feb. 25, 2003; Austrian Patent Office; 2 pages.

* cited by examiner

WASHING MACHINE

TECHNICAL FIELD

The present invention relates to a washing machine, and more particularly, to a washing machine with a structure to prevent bubbles generated inside the washing machine from being leaked to an outside.

BACKGROUND ART

Generally, a washing machine has a drum equipped therein and washes laundry by rotating the drum. In this washing machine, there is also installed a tub for accommodating the drum, preliminarily storing washing water and feeding the stored washing water to the drum. The tub is connected with an inlet pipe, and the inlet pipe is connected with a detergent box so as to feed the detergent along the washing water to the tub.

However, the bubbles generated by the detergent during a washing are introduced into the detergent box through the inlet pipe to contaminate the detergent box. Further, the bubbles may be leaked to the outside through the detergent box and may contaminate the washing machine and the surrounding thereof.

In particular, compared with the top loading type of washing machine in which the drum and the tub stand, the front loading type of washing machine causes more serious bubble generation, so that the leakage possibility of the generated bubbles increases. To this end, in the front loading type of washing machine, it is requested that the detergent particularly generating a small amount of bubbles be used. However, the use of such a detergent does not exclude the leakage possibility of the bubbles completely.

DISCLOSURE OF THE INVENTION

Accordingly, the present invention is directed to a washing machine that substantially obviates one or more of the problems due to limitations and disadvantages of the related art.

An object of the present invention is to provide a washing machine which enables to prevent bubbles generated in the drum and the tub from being leaked. As bubble cutoff means, a valve assembly for closing the opening and the pipe is installed in the opening to selectively close the pipe.

Additional features and advantages of the invention will be set forth in the description which follows, and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, there is provided a washing machine including: a tub installed inside a housing, for storing washing water, the tub including at least one opening and at least one pipe connected with the opening; a drum installed inside the tub and configured to wash laundry; and cutoff means for preventing bubbles generated in the drum and the tub from being leaked to an outside through the opening and the pipe.

The opening is an inlet opening for feeding washing water from an external water feed source within the tub and the pipe is an inlet pipe connected with the inlet opening. Alternatively, the opening is a ventilation opening for inflowing external air into the tub and the pipe is a ventilation pipe connected with the ventilation opening.

Preferably, the cutoff means comprises a valve assembly installed in the opening, for selectively opening and closing the pipe such that the bubbles generated in the drum and the tub are not leaked to the outside.

Preferably, the valve assembly comprises: a valve installed in the opening and configured to ascend by the bubbles; and a guide provided in the opening, for guiding the movement of the valve.

The valve assembly is provided in the opening and is installed within an extension pipe coupled with the pipe. Also, the valve is smaller than the opening and is larger than the diameter of the pipe.

Preferably, the pipe has a diameter that is partially reduced adjacent to the opening such that the pipe is stably closed by the valve. More preferably, the pipe has a rib inwardly extended from an inner circumferential surface thereof, or is a corrugated tube or a bellows tube having a plurality of corrugations.

In a first type of the valve assembly, the valve is a floating body with a predetermined size, and preferably has a circular section.

In addition, the guide is a plurality of ribs extended from the inner circumferential surface of the opening by a predetermined length. The rib is extended to have a predetermined interval from the valve, and has an extending portion extended from an end thereof, for supporting the valve.

In a second type of the valve assembly, the valve comprises: a floating body with a predetermined size; and an elastic member enclosing the floating body. The floating body is made of Styrofoam and the elastic member is made of rubber. Preferably, the floating body has a circular section.

Preferably, the valve has a beveled upper surface. More preferably, the valve is a conic type.

In addition, the guide is a plurality of ribs extended from an inner circumferential surface of the opening by a predetermined length. The respective ribs are extended to have a predetermined interval from the valve, and have an extending portion extended from an end thereof, for supporting a lower portion of the valve.

Preferably, the valve further comprises an extending portion extending from a lower portion of the floating body and inserted between the extending portions of the respective ribs. More preferably, an interval between the valve and the rib is greater than an interval between the extending portion of the valve and a stepped portion of the rib.

In a third type of the valve assembly, the valve comprises: a floating body having a convex surface; and an axial part extending from a lower portion of the floating body so as to be guided by the guide. The floating body is a hemispherical cell. Preferably, the floating body further comprises a flange horizontally extended from an edge thereof. Preferably, the axial part is a hollow shaft, and more preferably, comprises an outer circumferential surface covered with an elastic material layer.

Further, the guide comprises: a hub movably accommodating the axial part and supporting a lower portion of the floating body; and a plurality of ribs extended between an outer circumferential surface of the hub and an inner circumferential surface of the opening. The rib has a length which is constant at a location adjacent to the inner circumferential surface of the opening and increases at a location adjacent to the outer circumferential surface of the hub.

Preferably, the valve further comprises an elastic member provided on an outer circumferential surface of the axial part and positioned between the hub and the floating body. More preferably, the elastic member comprises a buffer protrusion formed at a lower end thereof.

In the meanwhile, it is preferable that the valve assembly further comprises a late member installed at a lower portion of the valve, for partially closing the opening such that the valve does not ascend by air flow. Here, the plate member is a circular plate type, and the plate member has a size that is equal to or greater than the section of a lower portion of the valve. In more detail, the plate member further comprises: at least one leg vertically extended from the lower surface thereof; and a hook formed at an end of the leg and fixed to a part of the guide.

Also, the cutoff means further comprises a joint assembly for fixing the pipe to the housing and partially closing the pipe such that the bubbles are not leaded to the outside.

The joint assembly comprises: a penetration hole formed in the housing; and an extension pipe including a vertically extended inner barrier rib inserted into the penetration hole and coupled with the pipe.

The penetration hole comprises a rib vertically formed at a circumference thereof, and the extension pipe comprises a flange configured to be in contact with the housing. Also, the penetration hole further comprises at least one cutout portion, and the extension pipe further comprises at least one hook formed at a predetermined interval on an outer circumferential surface thereof and inserted into the cutout portion.

The extension pipe further comprises a plurality of protrusions formed on the flange, and a plurality of auxiliary penetration holes into which the plurality of protrusions are inserted are formed at a circumferential portion of the penetration hole. Here, the protrusions further comprise a cylindrical type protrusion or a hemispherical type protrusion. More preferably, a cutout groove having a predetermined length is formed around the protrusion such that the protrusion is elastically connected with the flange.

According to the aforementioned invention, bubbles are not discharged outside the washing machine, so that the contamination of the washing machine is prevented.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

BEST MODE FOR CARRYING OUT THE INVENTION

Reference will now be made in detail to first and second preferred embodiments of the present invention, examples of which are illustrated in the accompanying drawings. Wherever possible, the same reference numbers will be used throughout the drawings to refer to the same or like parts, and additive explanation thereof will be omitted.

Figure 1:
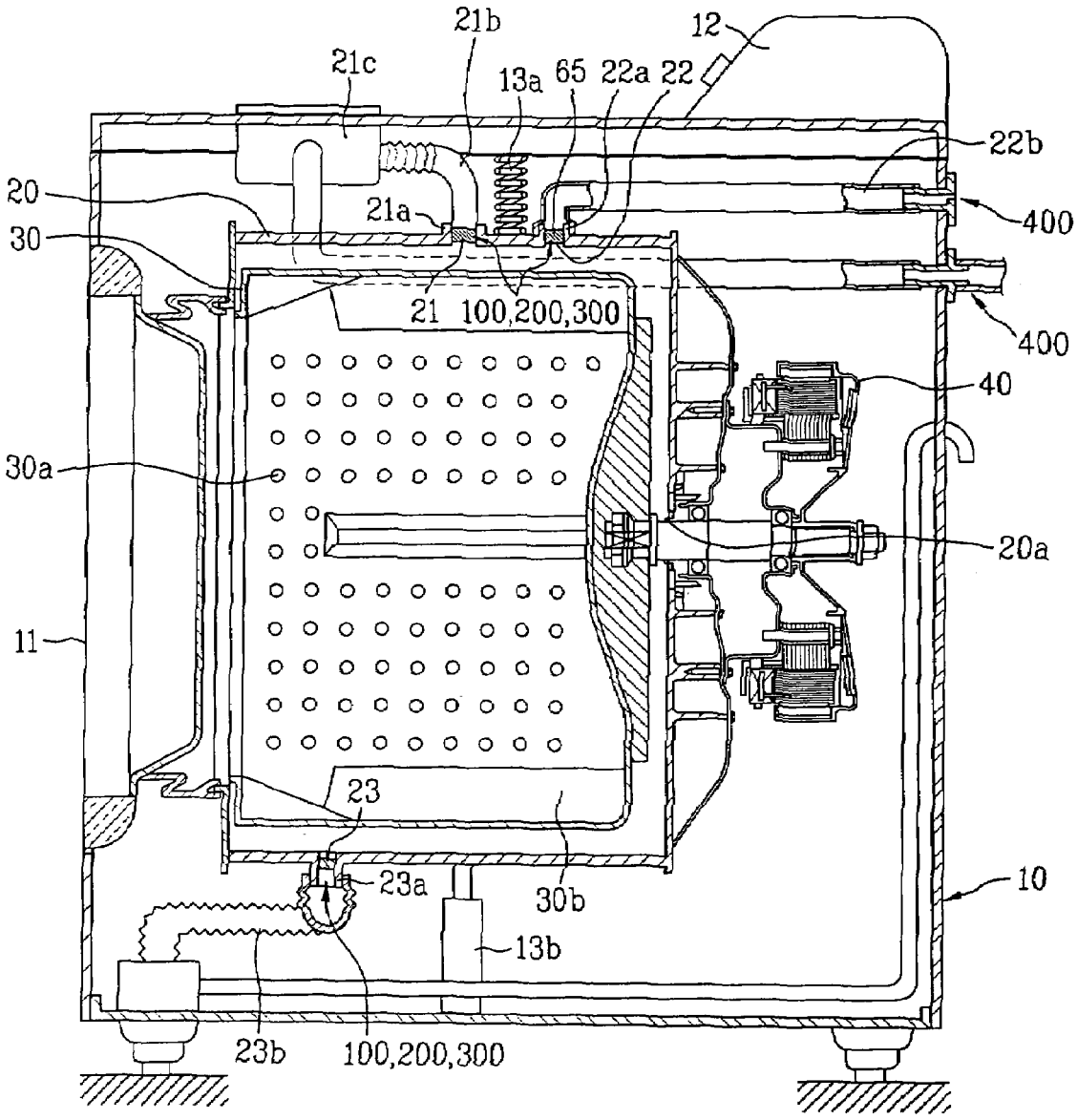
FIG. 1 is a side sectional view of a washing machine according to the present invention.

FIG. 1 is a side sectional view of a washing machine according to the present invention, and the washing machine is described with reference to FIG. 1. The washing machine shown in FIG. 1 is the front loading type, but is nearly the same as the top loading type except that the tub 20 and the drum are laid. Accordingly, for the briefness of description, the invention will be described with reference to the washing machine of the front loading type, but it will be equally applied to the washing machine of the top loading type.

As shown in FIG. 1, the washing machine according to the present invention includes a housing 10, and a tub 20 and a drum 30 installed within the housing 10.

The housing 10 is designed such that various kinds of elements are installed therein, and it protects these elements. On the front of the housing 10, there is installed a door 11 configured to open and close the entrance connected with the drum 10. A control panel 12 is installed on the housing 10. A user instructs the operation of the washing machine using the control panel 12, and puts laundry in or out of the drum 30 through the door 11.

The tub 20 preliminarily stores washing water so as to supply washing water into the inner tub at a constant amount during the washing. The tub 20 is elastically fixed within the housing by using damping units 13*a*, 13*b*. A penetration hole 23 is formed at the center of the bottom face of the tub 20, and a drive shaft connected with the drum 30 is installed through the penetration hole 23. In addition, the tub 20 includes a plurality of openings 21, 22, 23 and pipes 21*b*, 22*b*, 23*b* connected with the openings 21, 22, 23. These openings 21, 22, 23 have extension pipes 21*a*, 22*a*, 23*a*, and the respective pipes 21*b*, 22*b*, 23*b* can be more firmly connected to the extension pipes 21*a*, 22*a*, 23*a*. The tub 20 can be connected with various external devices that are necessary for operating the tub 20 by using the openings 21, 22, 23 and the pipes 21*b*, 22*b*, 23*b*. In more detail, the tub 20 has an inlet opening 21 for inflowing washing water and an inlet pipe 21*b* connected to the inlet opening 21. The inlet pipe 21*b* is connected between the inlet opening 21 and a detergent box 21*c*, and is again extended to an external water supply source through the housing 10 from the detergent box 21*c*. The washing water is supplied from the water supply source into the tub 20 via the inlet pipe 21*b*, the detergent box 21*c* and the inlet opening 21 along with the detergent. An outlet opening 23 is formed in the tub 20, and an outlet pipe 23*b* is connected to the outlet opening 23. The outlet pipe 23*b* is extended to an external drain unit. Used washing water is drained through the outlet opening 23 and the outlet pipe 23*b*.

In the meanwhile, the drum 30 of the large capacitive washing machine is large in size, a child may enter the inside of the drum 30. To this end, although the door 11 is closed, a ventilation opening 22 is formed at the tub 20 such that the child breathe within the drum 30. Also, a ventilation pipe 22*b* is installed to be connected to the ventilation opening 22 and communicates with the outside of the washing machine. Accordingly, the ventilation pipe 22*b* and the ventilation opening 22 function to supply external air into the tub 20, thereby preventing the child from being suffocated.

The drum 30 accommodates laundry and is rotatably installed within the tub 20. In addition, the drum 30 includes a plurality of penetration holes 30*a* such that washing water is introduced from the tub 20. A plurality of baffles 30*b* are attached to an inner circumferential surface of the drum 30 such that the laundry is easily mixed. In the meantime, a drive part 40 is installed adjacent to the tub 20 and provides a power to the drum 30 so as to rotate the drum 30. The drive part 40 generally includes a motor, a clutch or the like, and is operatably connected by the drum 30 and the drive shaft as aforementioned.

In the operation of the washing machine, washing water and detergent are mixed with each other by the rotation of the drum 30 so that bubbles are generated. These bubbles may be leaked outside the washing machine through the openings 21, 22, 23 and the pipes 21*b* 22*b*, 23*b*. For instance, the bubbles are leaked outside the washing machine through the detergent box 21*c* via the inlet opening 21 and the inlet pipe 21*b*. As shown in FIG. 1, since the ventilation opening 22 and the ventilation pipe 22*b* directly communicate with the outside of the washing machine, the bubbles can be easily leaked through the housing 10. To this end, the washing machine of the present invention includes cutoff means for preventing the bubbles from being leaked to the outside of the washing machine. On the other hand, the outlet opening 23 and the outlet pipe 23*b* do not communicate with the outside, and they periodically drain the washing water. Since the possibility in the leakage of the bubbles through the outlet opening 23 and the outlet pipe 23*b* is small, the cutoff means is more effective in the inlet opening 21 and the ventilation opening 22. Accordingly, in the below, the cutoff means will be mainly described with embodiments applied to the inlet opening 21 and the ventilation opening 22, but it is apparent that these embodiments can be applied to the outlet opening 23.

First, since the bubbles start to be leaked from the opening, it is effective to block the bubbles at the opening. Accordingly, a valve assembly as the cutoff means is installed in the opening, and is configured to close the pipes connected to the opening so as to block the bubbles. This valve assembly will be in more detail described in the below along with various embodiments.

Figure 2A:
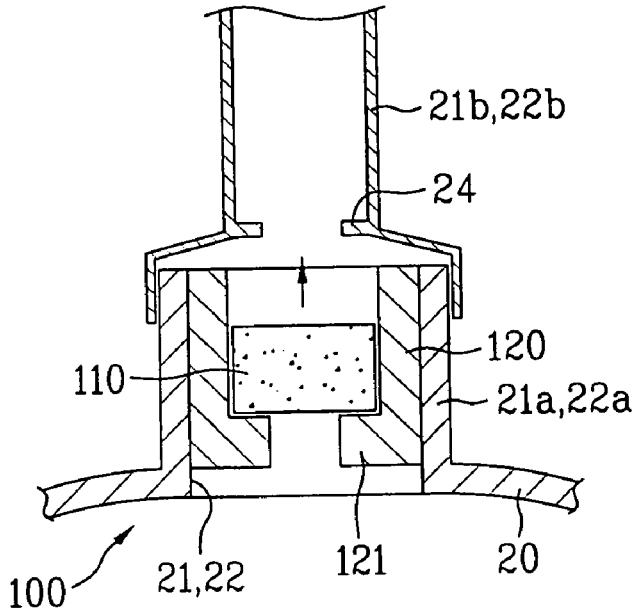
FIGS. 2A to 2C are sectional views of a valve assembly according to a first embodiment of the present invention.
Figure 2B:
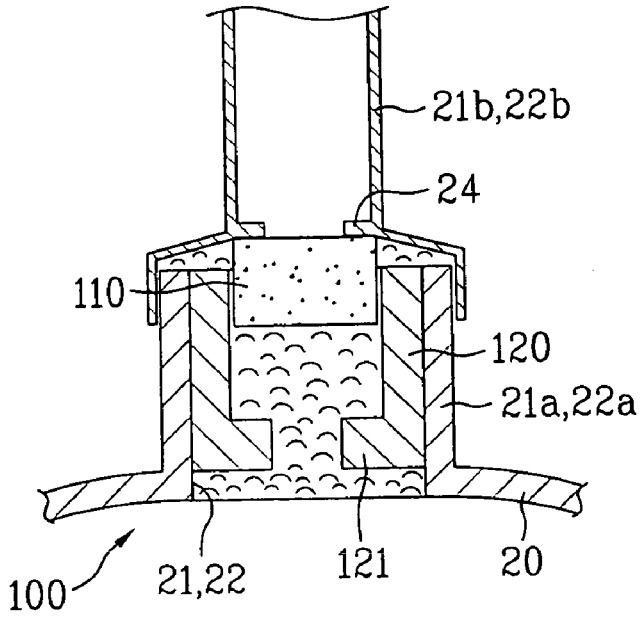
Figure 2C:
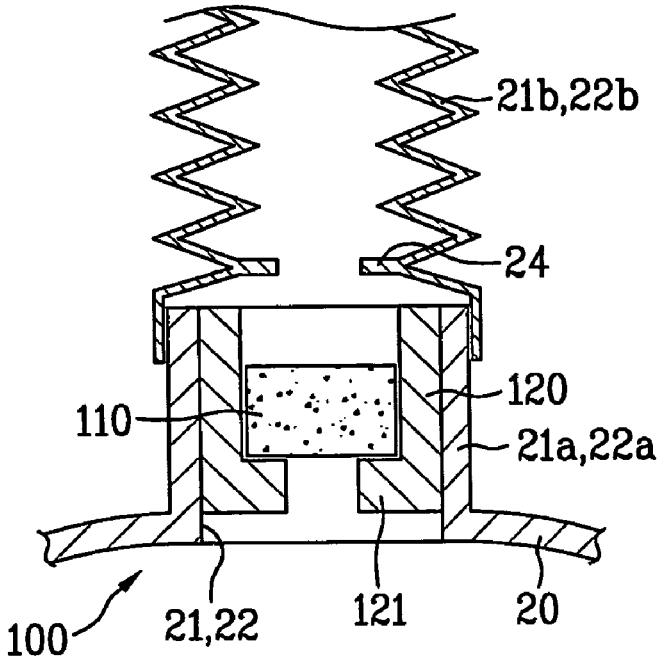
Figure 3:
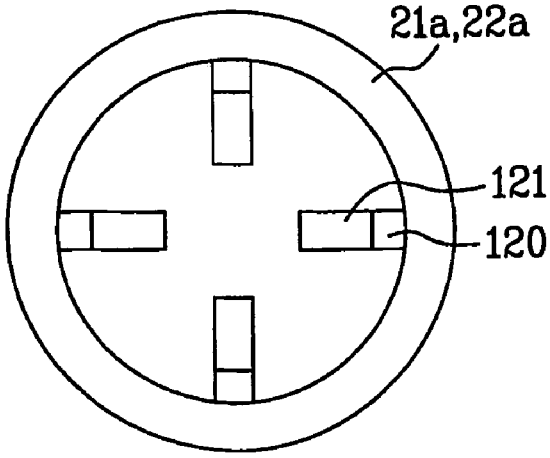
FIG. 3 is a plan view of the opening of the valve assembly according to the first embodiment of the present invention.
Figure 4:
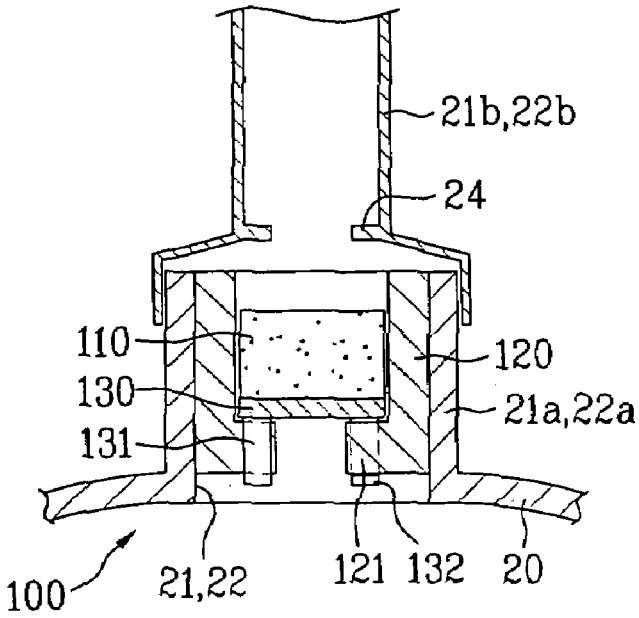
FIG. 4 is a sectional view showing a modified example of the first embodiment shown in FIGS. 2A to 2C.

FIGS. 2A to 2C are sectional views of a valve assembly according to a first embodiment of the present invention, and FIG. 3 is a plan view of the opening of the valve assembly according to the first embodiment of the present invention. Also, FIG. 4 is a sectional view showing a modified example of the first embodiment shown in FIGS. 2A to 2C.

As shown in FIG. 2A, the valve assembly 100 according to the first embodiment of the present invention includes a valve 110 installed in the inlet opening 21 and the ventilation opening 22 (hereinafter referred to as "openings"), and a guide 120 installed within the openings 21, 22. The valve assembly 100 may be installed directly on the inner circumferential surface of the openings 21, 22, but is preferably installed within the extension pipes 21*a*, 22*a* formed in the openings 21, 22 so as to operate stably. In the valve assembly 100, the valve 10 is configured to be movable up and down within the openings 21, 22, and the guide 120 is configured to guide the movement of the valve 110. The valve 110 should be smaller than the openings, more precisely, the extension pipes 21*a*, 22*a* so as to enable the flow of detergent and air through the openings 21, 22 and the smooth movement. In addition, the valve 110 is formed greater than the diameter of the inlet pipe 21*b* and the ventilation pipe 22*b* (hereinafter referred to as "pipes") so as to close the pipes 21*b*, 22*b*. In other words, the diameters of the pipes 21*b*, 22*b* may be designed smaller than the size of the valve 110 such that the pipes 21*b*, 22*b* are closed by the valve 110. Further, it is desirable that the diameters of the pipes 21*b*, 22*b* be partially reduced around the openings 21, 22 such that the pipes 21*b*, 22*b* can be more stably closed by the valve 110. For this, the pipes 21*b*, 22*b* can have a rib 24 placed adjacent to the openings 21, 22. The rib 24 is, as shown in the drawings, extended radially and inwardly from the inner circumferential surface of the pipes 21*b*, 22*b*. In addition, as shown in FIG. 2C, the pipes 21*b*, 22*b* may be a corrugated pipe or a bellows pipe. These pipes have a plurality of corrugations 24*a*, and these corrugations 24*a* result in the reduction of the diameter like the aforementioned rib 24. Accordingly, the valve 110 is in contact with the rib 24 or the corrugations 24*a* during the movement thereof, thereby closing the pipes 21*b*, 22*b* more firmly.

Hereinafter, the first embodiment is described in more detail. As shown in the drawings, the valve 110 includes a floating bodying body with a predetermined size. The valve 110 is made of a lightweight material, for example, Styrofoam, and can thus ascend by the bubbles. As aforementioned, the valve 110 is formed at least larger than the pipes 21*b*, 22*b*, and is preferably configured to have a circular section to correspond to the shapes of the extension pipes 21*a*, 22*a* and the pipes 21*b*, 22*b*. Also, the guide 120, as shown in FIG. 3, includes a plurality of ribs extended by a predetermined length from the inner circumferential surface of the openings 21, 22. As aforementioned, the ribs 120 may be formed more stably on the inner circumferential surface of the extension pipes 21*a*, 22*a*. These ribs 120 are extended to have a predetermined interval from the valve 110, thereby capable of movably guiding the valve 110. Also, each of the ribs 120 includes an extending portion 121 radially and inwardly from an end thereof. The extending portion 121 is protruded from the rib 120 to form a stepped portion. Accordingly, the extending portion 121 supports the valve 110 such that the valve 110 is located within the openings 21, 22 and the extension pipes 21*a*, 22*a*.

In the meanwhile, the valve 120 may ascend even by air flow through the openings 21, 22 as well as the bubbles. For instance, in case the door 11 of the washing machine is closed fast, the air within the tub 20 and the drum 30 flows fast through the openings 21, 22 by the movement of the door 11. As a result, the valve 110 closes the pipes 21*b*, 22*b*. However, the closing of the pipes 21*b*, 22*b* allows the tub 20 and the drum 30 to be sealed, so that a pressure is instantly generated within the tub 20 and the drum 30. The generated pressure causes the door not to be closed. Accordingly, as shown in FIG. 4, it is desirable that a plate member 130 be installed below the valve 110 such that the valve 110 is not influenced by the air flow.

Figure 5:
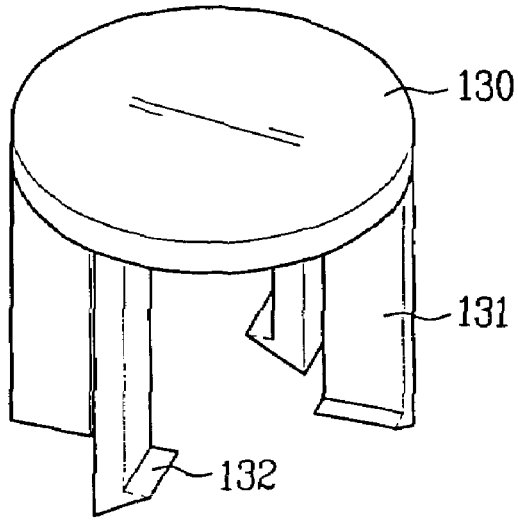
FIG. 5 is a perspective view of a plate member equipped in the modified example of FIG. 4.
Figure 6A:
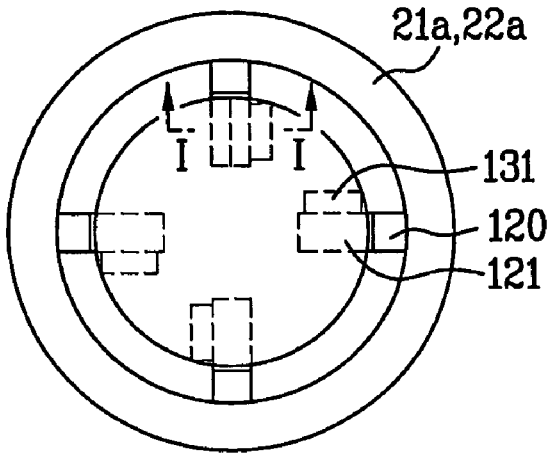
FIG. 6A is a plan view of the valve assembly according to the modified example of FIG. 4.

Referring to FIGS. 4 and 6A, the plate member 130 closes the openings 21, 22 and the extension pipes 21*a*, 22*a* such that the air flow does not reach directly the valve 110. However, as shown in the drawings, since the plate member 130 partially closes the openings 21, 22 and the extension pipes 21*a*, 22*a*, it permits the smooth supply of the washing water in the inlet opening and the smooth air flow in the ventilation opening 22. As shown in FIG. 5, the plate member 130 is preferably a circular plate type to approximately correspond with the shape of the valve 110. Also, in order to block an abrupt air flow and detour the air flow from the valve 110, it is desirable that the size of the circular plate member 130 be equal to or greater than the size of the lower side of the valve 110 facing with the circular plate member 130.

Figure 6B:
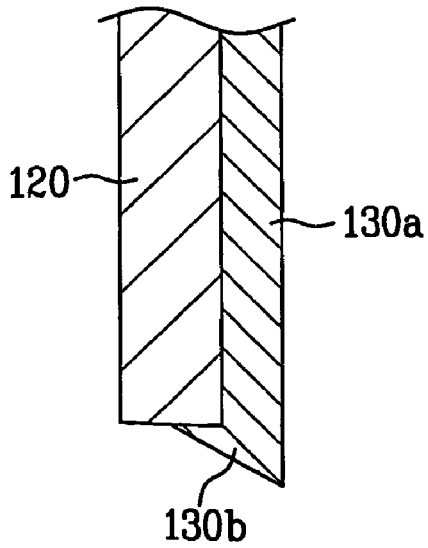
FIG. 6B is a partial sectional view taken along the line of FIG. 6A.

In addition, the plate member 130 is mounted on an extending portion 121 of the rib, so that the valve 110 is supported by the plate member 130. As shown in FIG. 5, the plate member 130 further includes legs 131 extending from the lower surface thereof and hooks 132 formed at ends of the legs 131. The legs 131 are, as shown in FIG. 6A, extended parallel to the ribs 120, and are supported such that the plate member 130 does not shake by the ribs 120. Also, as shown in FIG. 6B, the hook 132 is latched by a lower end of the rib 120, thereby fixing the plate member 130 to the rib 120.

Figure 7A:
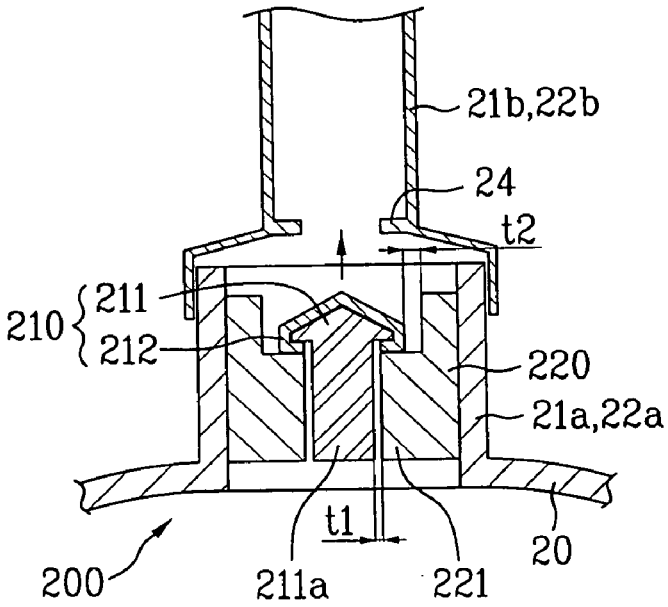
FIGS. 7A and 7B are sectional views of a valve assembly according to a second embodiment of the present invention.
Figure 7B:
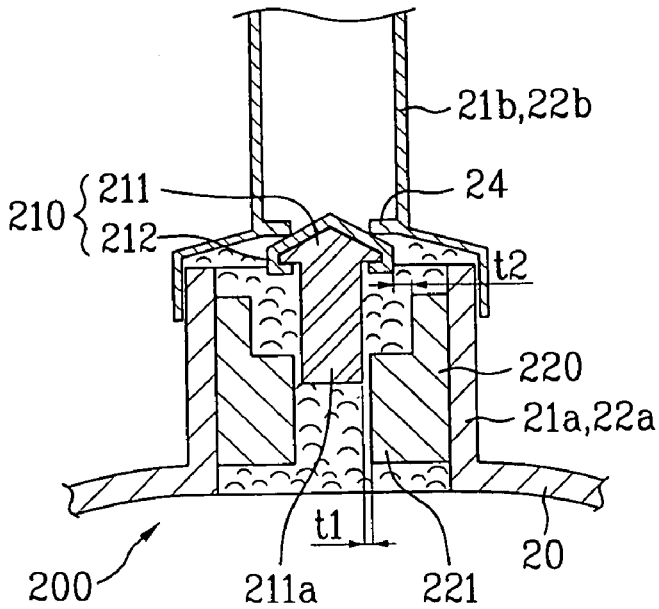
Figure 8:
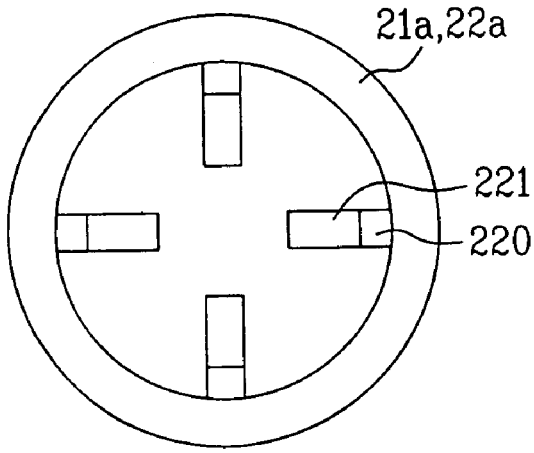
FIG. 8 is a plan view of the opening of the valve assembly according to the second embodiment of the present invention.

A valve assembly according to a second embodiment of the present invention is shown in FIGS. 7A and 7B, and FIG. 8, and the second embodiment will be described in detail with reference to these drawings.

Similarly with the valve assembly 100 of the first embodiment, a valve assembly 200 of the second embodiment includes a valve 210 installed within openings. 21, 22 and a guide 220. Preferably, the valve 210 and the guide 220 are installed within extension pipes 21*a*, 22*a*. The basic characteristics of the valve 210 and the guide 220 are the same as those of the valve 110 and the guide 120 according to the first embodiment. In other words, the valve 210 is guided by the guide 210 and is movable up and down. The size of the valve 210 and the diameters of the pipes 21*b*, 22*b* are properly designed such that the pipes 21*b*, 22*b* are closed by the valve 210. Also, the pipes 21*b*, 22*b* may have a rib 24 such that the valve 210 is latched with ease. Alternatively, the pipes 21*b*, 22*b* may have a plurality of corrugations 24*a* as shown in FIG. 2C.

In the second embodiment described above, the valve 210 includes a floating body 211 with a predetermined size, and an elastic member 212 enclosing the floating body 211. Like the first embodiment, the floating body 211 can be made of Styrofoam that is a lightweight material, and has a circular section to be appropriate for the circular type of openings 21, 22, the extension pipes 21*a*, 22*a*, and the pipes 21*b*, 22*b*. Since this floating body 211 is made of a lightweight and weak material (i.e., Styrofoam), it may be gradually fractured with being in contact with the pipes 21*b*, 22*b* and the guide 220 during the ascent or descent by the bubbles. Accordingly, the elastic member 212 preferentially protects the floating body 211, and may be preferably made of rubber. Since the elastic member 212 absorbs impact, it reduces the noise generated by the movement of the valve 210. At least one beveled surface is preferably formed at an upper side of the valve 210. In other words, the beveled surface is formed at the upper side of the floating body 211, and a beveled surface is formed at the same location of the elastic member 212 so as to enclose the floating body 211. This is because, although the valve 10 ascends obliquely by some degree, the beveled surface enables the valve 210 to precisely close the pipes 21*b*, 22*b* while being guided by the pipes 21*b*, 22*b*. More preferably, beveled surfaces are continuously formed around the valve 210, which enable to guide the floating body 211 and precisely close the pipes 21*b*, 22*b* although the valve is oblique in any direction. As shown in the drawings, these continuous beveled surfaces substantially permit the valve 210 to have a conic structure.

As shown in FIG. 8, the guide 220 is substantially similar to the guide 120 of the first embodiment. In other words, the guide 220 includes a plurality of ribs 220 extended from the inner circumferential surfaces of the openings 21, 22 or the extension pipes 21*a*, 22*a* so as to have a predetermined interval from the valve 210. Also, each of the ribs 220 has an extending portion 221 radially extended from an end thereof, and the valve 20 is supported by the extending portion 221.

Figure 9:
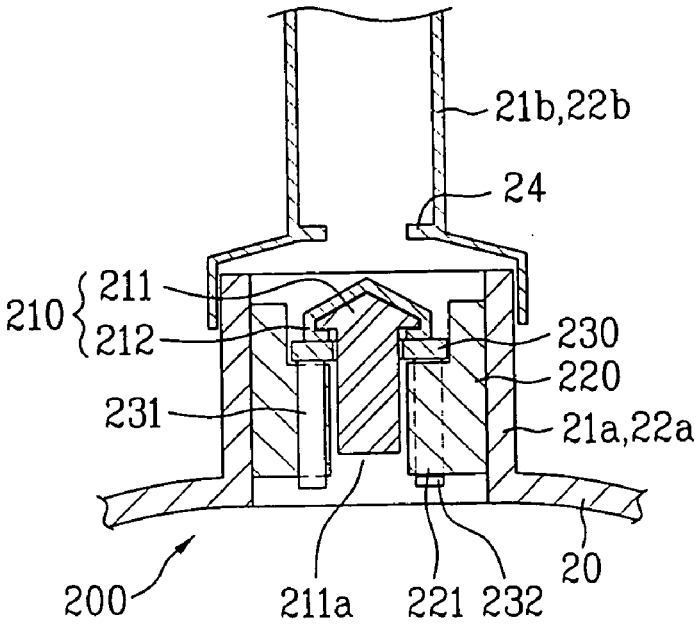
FIG. 9 is a sectional view showing a modified example of the second embodiment shown in FIGS. 7A and 7B.
Figure 10:
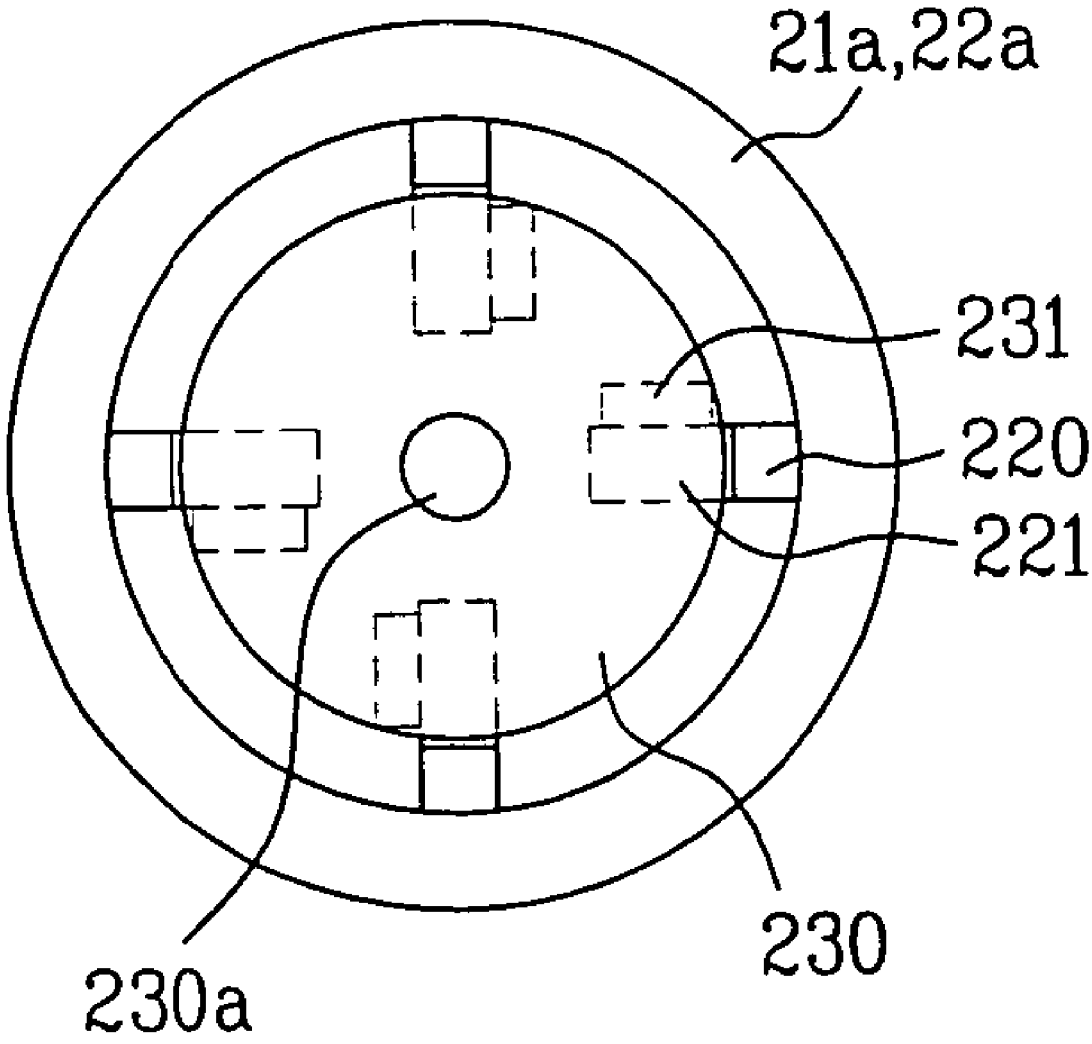
FIG. 10 is a plan view of a valve assembly according to a modified example of FIG. 9.

In addition, as shown in FIGS. 9 and 10, for the valve 210 so as not to ascend due to the air flow, a plate member 230 is installed below the valve 210. The plate member 230 includes legs 231 extended from the lower side thereof and hooks 232 formed at ends of the legs 231 and fixed to lower ends of the ribs 220 like the first embodiment. Since the plate member 230 is the same as the plate member 130 of the first embodiment, its detailed description will be omitted.

As shown in FIGS. 7A, 7B and 9, the floating body 211 may further include an extending portion 211*a* vertically extended from a lower side thereof. The extending portion 211*a* is inserted between the extending portions 221, and thereby is supported and guided by the extending portions 221. In case the aforementioned plate member 230 exists, a penetration hole 230*a* for the extending portion 211*a* is formed in the plate member 230 as shown in FIG. 10, and the extending portion 211*a* is guided and supported even by the penetration hole 230*a*. Accordingly, the whole of the valve 210 can ascend or descend more stably by the extending portion 211*a*. In the meanwhile, the interval (t2) between the valve 210 and the rib 220 is preferably greater than the interval (t1) between the extending portion 211*a* and the extending portion 221. By adjusting the aforementioned intervals, the valve 210 is movable without contacting with the rib 220, and the extending portion 211*a* can be well supported and guided by the extending portion 221.

Hereinafter, a valve assembly according to a third embodiment of the present invention will be described in more detail.

Figure 11A:
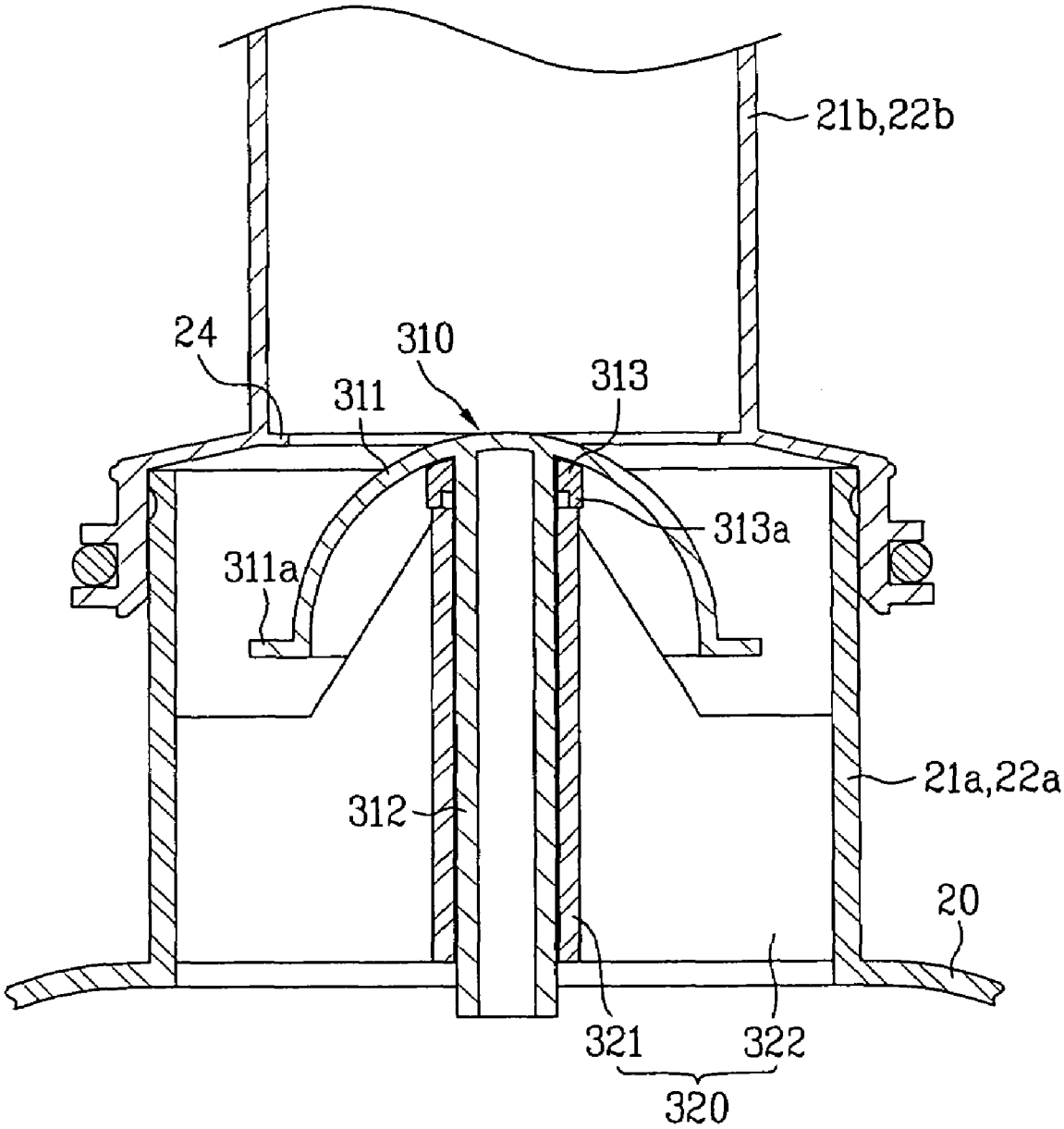
FIGS. 11A and 11B are sectional views of a valve assembly according to a third embodiment of the present invention.
Figure 11B:
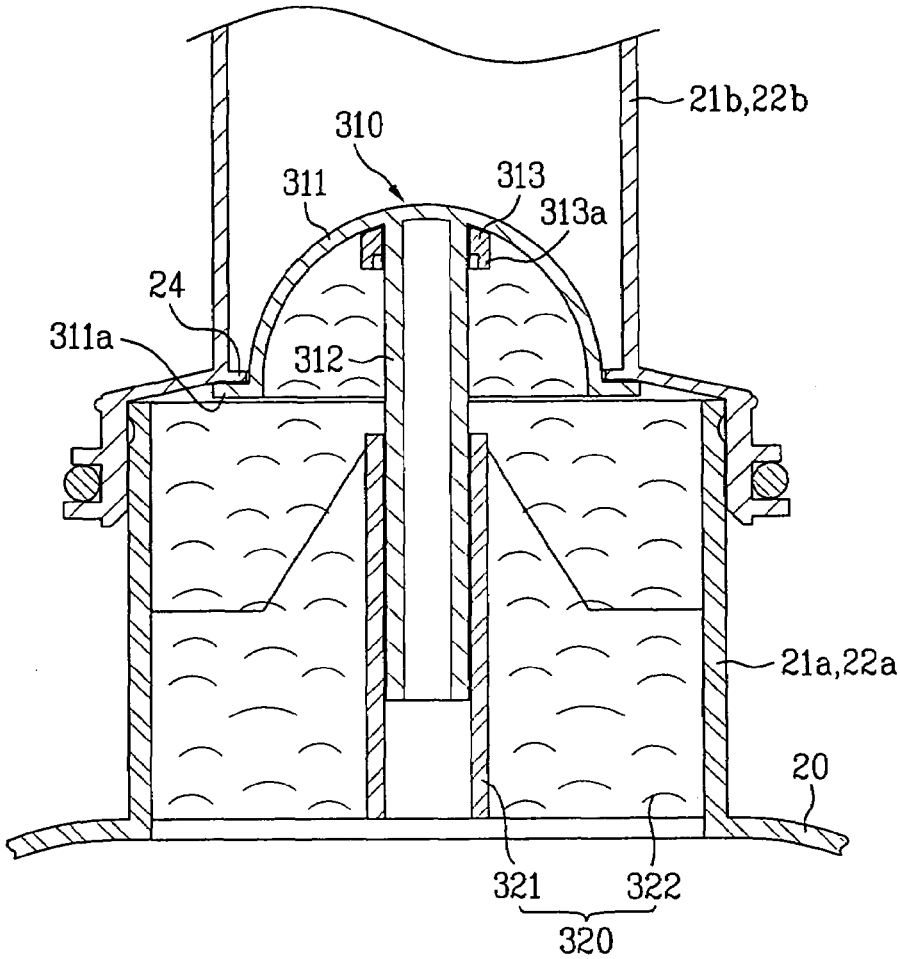
Figure 12:
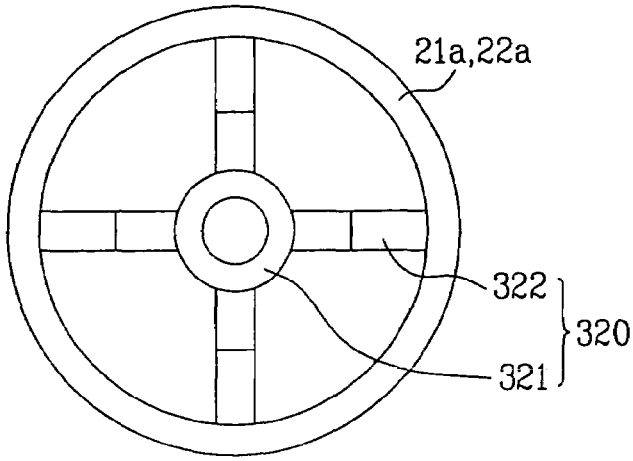
FIG. 12 is a plan view of the valve assembly according to the third embodiment of the present invention.

FIGS. 11A and 11B are sectional views of a valve assembly according to a third embodiment of the present invention, and FIG. 12 is a plan view of the valve assembly according to the third embodiment of the present invention.

Similarly with the valve assemblies of the first and second embodiments, a valve assembly 300 of the third embodiment includes a valve 210 installed within openings 21, 22 or extension pipes 21*a*, 22*a*, and a guide 220. Since general characteristics related with the valve 210, the guide 220 and the extension pipes 21*a*, 22*a* are described in the foregoing first and second embodiments, detailed description thereof will be omitted.

In the third embodiment, the valve 310 includes a floating body 311 and an axial part 312 extended from the bottom surface of the floating body 311. The floating body 311 is formed to have a convex surface as a whole as shown in FIGS. 11A and 11B. The convex surface is guided by the inner circumferential surface of the pipes 21*b*, 22*b* during its ascent, thereby permitting the floating body 311 to precisely and easily close the pipes 21*b*, 22*b*. The floating body 311 is preferably a hemispherical shell having a convex curvature as a whole so as to reduce its weight. Like the first and second embodiments, the floating body 311 is made of Styrofoam that is a lightweight material. Alternatively, the floating body 311 may be made of plastic material owing to its lightweight property. Accordingly, the strength of the floating body 311 is reinforced, and endurance is also enhanced. In addition, since the floating body 311 that is the hemispherical shell has a space formed therein, it is subject to a larger buoyancy from the bubbles and thus ascends with ease. In the meanwhile, it is desirable that the floating body 311 further include a flange 311*a* horizontally extended from an edge thereof so as to be stably in contact with the pipes 21*a*, 21*b*. The axial part 312 is guided by the guide 320 so that the valve 310 moves stably. In order to reduce the weight of the valve 310, the axial part 312 is preferably formed in a hollow shaft As shown in FIG. 12, the guide 320 includes a hub 321 arranged within the openings 21, 22 and the extending portions 21*a*, 22*a*, and ribs 322 connecting the hub 321 with the openings 21, 22/the extension pipes 21*a*, 22*a* The hub 321 accommodates the axial part 312 movably, and supports the floating body 311 so as to be located within the extension pipes 21*a*, 22*a*. The ribs 22 are substantially extended from the outer circumferential surface of the hub 321 to the inner circumferential surfaces of the openings 21, 22 and the extension pipes 21*a*, 22*a*. As shown in FIG. 11A, the length of the rib 322 placed around the hub 321 is formed preferably longer than other portions. Accordingly, the bonding length between the hub 321 and the ribs 321 is lengthened, so that the ribs 321 are firmly connected with the hub 321.

Also, as shown in FIG. 13A to FIG. 14B, in order to prevent the ascent of the valve 310 due to the air flow, a plate member 330 is installed below the valve 310. Since the general characteristics of the plate member 330 are described in the first and second embodiments, its detailed description will be omitted.

Figure 13A:
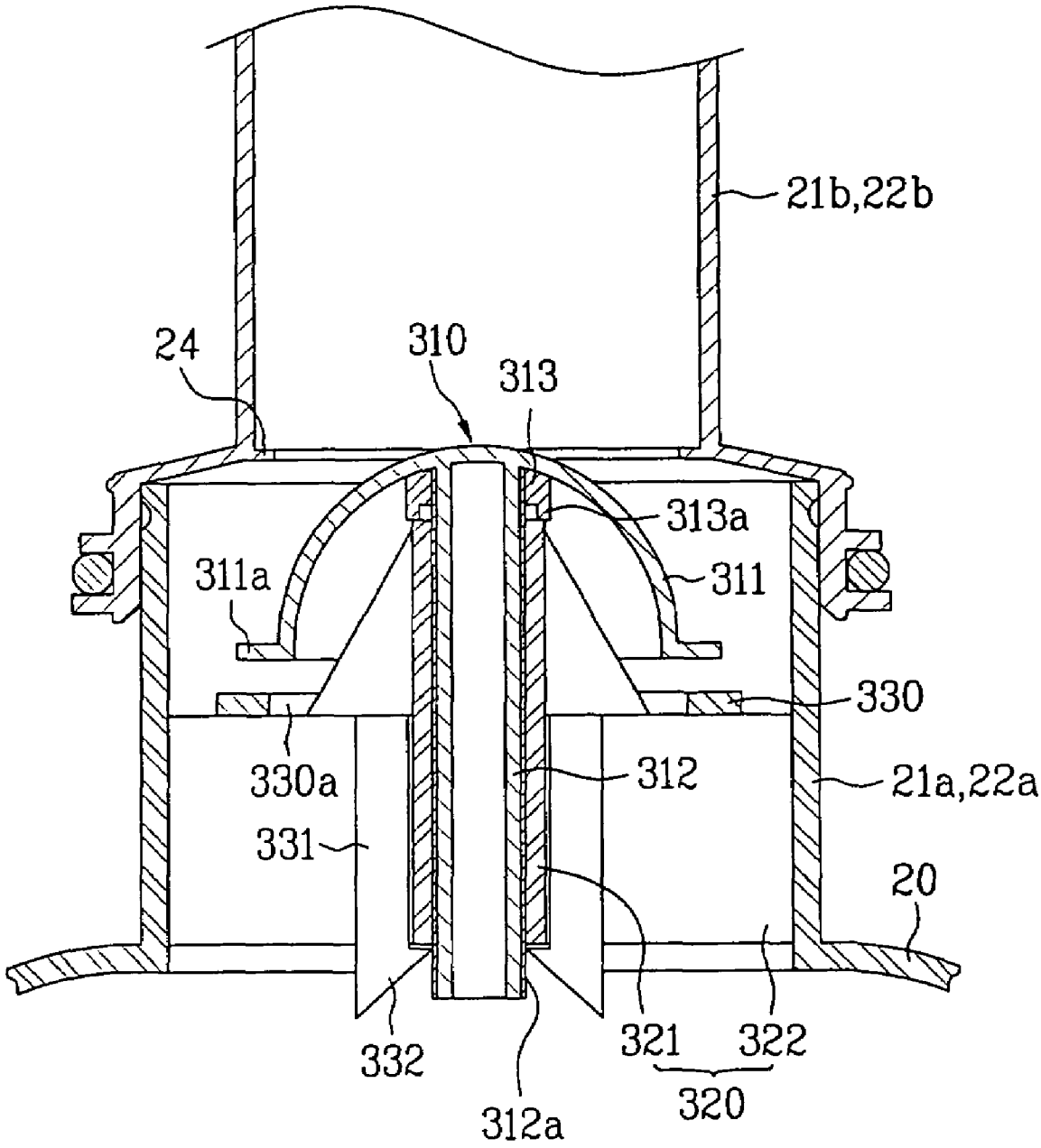
FIGS. 13A and 13B are sectional views of the third embodiment shown in FIGS. 11A and 11B.
Figure 13B:
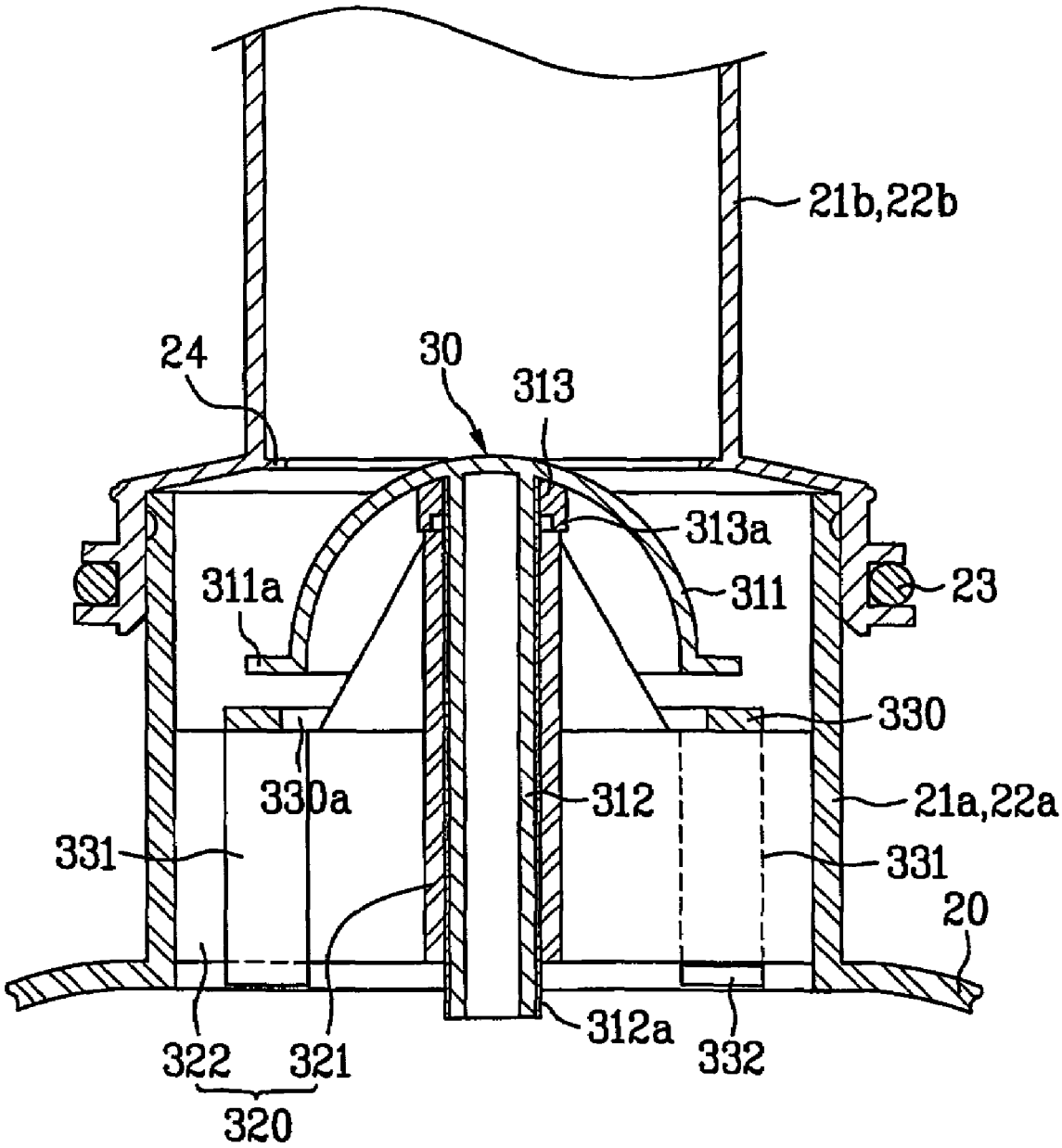
Figure 14A:
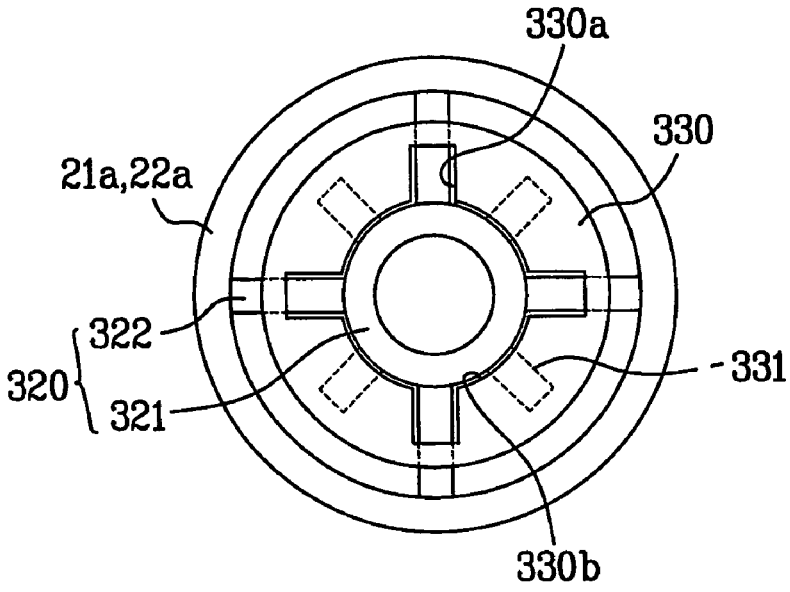
FIGS. 14A and 14B are plan views of the opening of the valve assembly according to the modified example of FIGS. 13A and 13B.
Figure 14B:
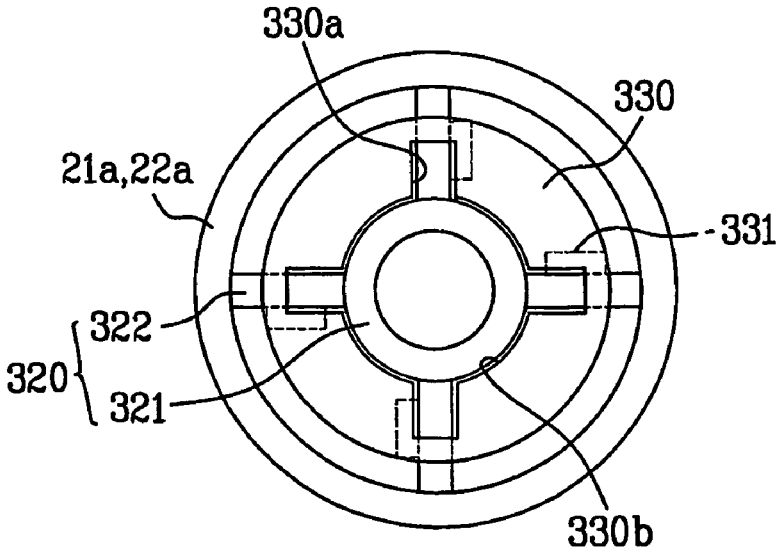

The plate member 330 is mounted on the ribs 322. For this structure, the ribs adjacent to the inner circumferential surfaces of the openings 21, 22 and the extension pipes 21*a*, 22*a* have a constant length. As shown in FIGS. 14A and 14B, the plate member 330 further includes a penetration hole 330*b* and a plurality of slots 330*a* for a long rib 323 around the hub so as to be mountable on the rib 322. Also, the plate member 330 includes legs 331 extended from the lower side thereof and hooks 332 formed at ends of the legs 331. As shown in FIGS. 13A and 14A, the legs 331 are extended to have a constant interval from the ribs 322, and are supported on the outer circumferential surface of the hub such that the plate member 330 does not shake. Also, the hooks 332 are latched with lower ends of the hub 321 to fix the plate member 330 to the hub 321. On the other hand, as shown in FIGS. 13B and 14B, the legs 331 are extended parallel to the ribs 322 and are supported by the ribs 322 such that the plate member 330 does not shake. In addition, the hooks 332 are latched with lower ends of the ribs 322 to fix the plate member 330 to the ribs 322.

The valve 310 may further include an elastic member 313 provided on the outer circumferential surface of the axial part 312. The elastic member 313 has a ring shape substantially, and is installed to be in contact with the inner surface of the floating body 311. The elastic member 313 is interposed between the upper side of the hub 321 and the inner surface of the floating body 311. Accordingly, the elastic member 313 elastically supports the valve 310 so as to prevent impact and noise. Preferably, a protrusion 313*a* is further formed at a lower end of the elastic member 313. The protrusion 313*a* is easily deformed when it is in contact with the upper side of the hub 321, thereby preventing impact and noise more effectively. On the other hand, on the outer circumferential surface of the axial part 312, an elastic material layer 312*a* can be formed. The elastic material layer 3 absorbs the impact between the hub 321 and the axial part 312 during the elevation of the valve 310, thereby capable of reducing noise remarkably.

In the meanwhile, although the aforementioned valve assemblies 100, 200, 300 block bubbles, if the bubbles are generated excessively, the bubbles may be leaked to the outside of the washing machine even through the aforementioned valve assemblies. As shown in FIG. 1, in order to fix the pipes 21*b*, 22*b* to the housing 10 and connect the pipes 21*b*, 22*b* with external pipes if necessary, a joint assembly 400 is installed. Since the joint assembly 400 is located at a boundary of the washing machine, e.g., in the housing 10, the bubbles can be blocked lastly and perfectly at the joint assembly 400. Accordingly, the joint assembly 400 is further included in the present invention as the cutoff means and will be described in more detail.

Figure 15A:
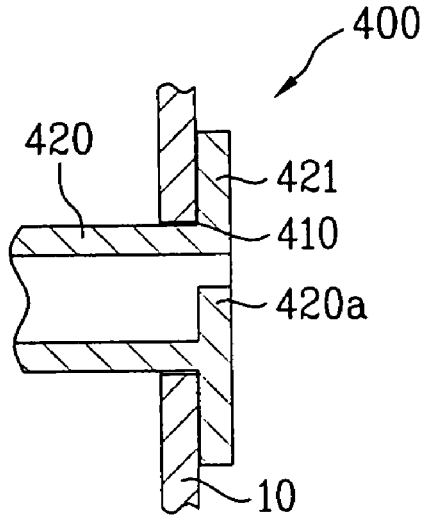
FIGS. 15A and 15B are sectional view and front view of a joint assembly according to the present invention.
Figure 15B:
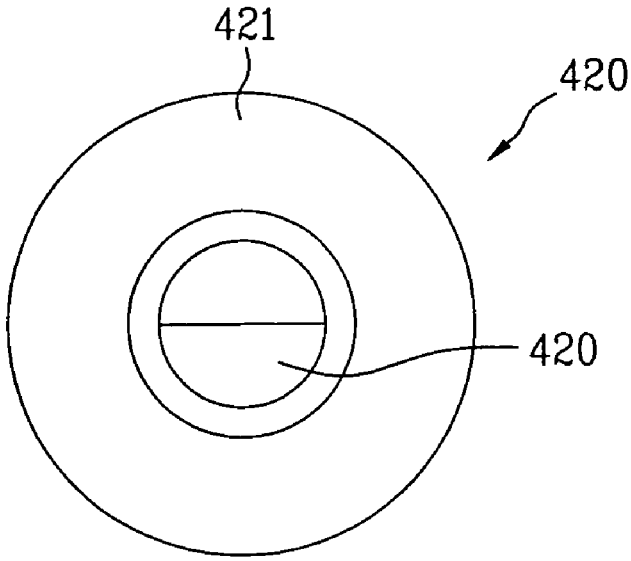

FIGS. 15A and 15B are sectional view and front view of a joint assembly according to the present invention.

The joint assembly 400 of the present invention includes a penetration hole 410 formed in the housing 10 and an extension pipe 420 inserted into the penetration hole 410. The extension pipe 420 is connected with the pipes 21*b*, 22*b* and is also inserted into the penetration hole 410, thereby fixing the pipes 21*b*, 22*b* to the housing 10. The housing 10 is extended to be coupled with an external pipe outside the washing machine, so that the pipes 21*b*, 22*b* are connected with the external pipe. Like this, a vertically extended inner barrier rib 420*a* is formed within the extension pipe 420 as shown in the drawings. The inner barrier rib 420*a* results in partially closing the extension pipe 420 and partially closing the pipes 21*b*, 22*b* connected to the extension pipe 420. Accordingly, no matter how much the amount of the generated bubbles is, since the amount of the bubbles leaked from the valve assemblies 100, 200, 300, 400 is small, the inner barrier rib 420*a* prevents the bubbles from being leaked.

Figure 16A:
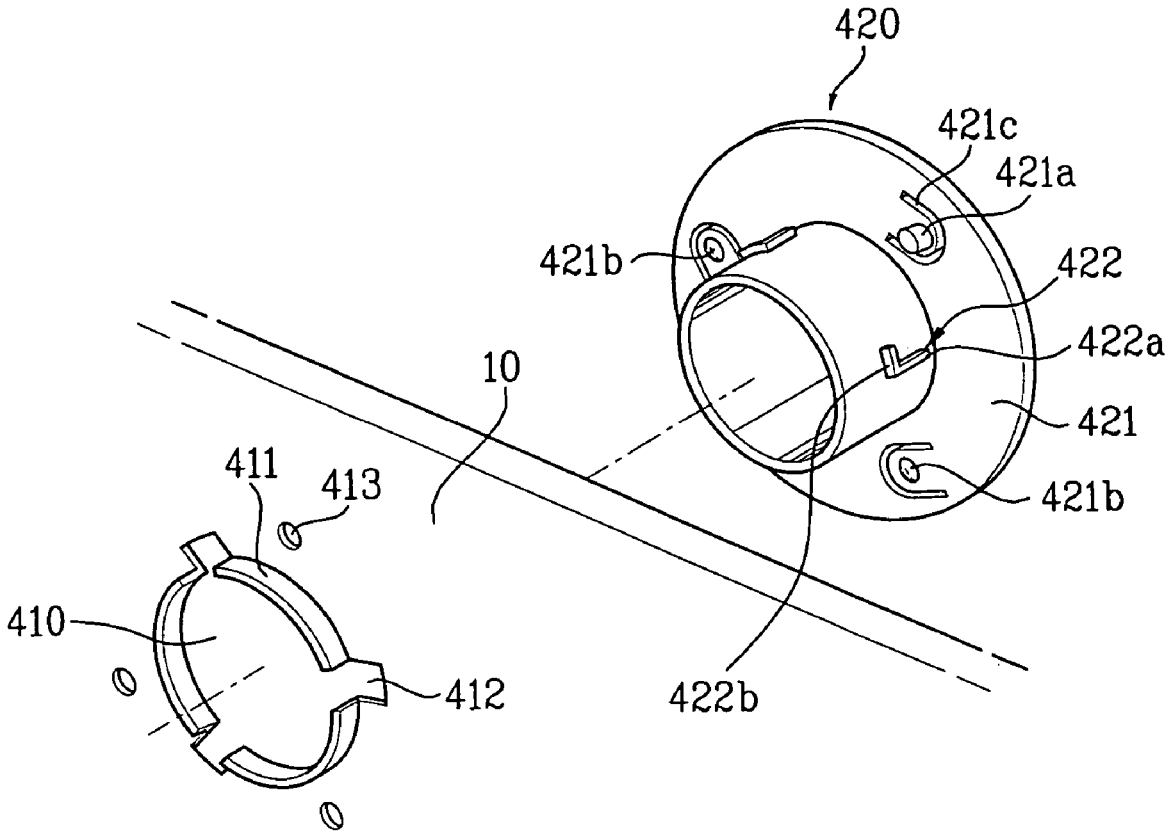
FIGS. 16A to 16C are partial sectional views showing an assembly process of the joint assembly according to the present invention.
Figure 16B:
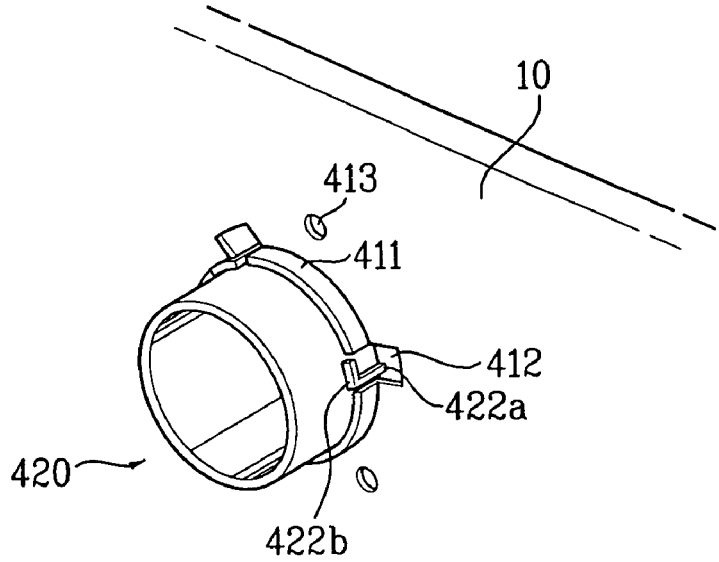
Figure 16C:
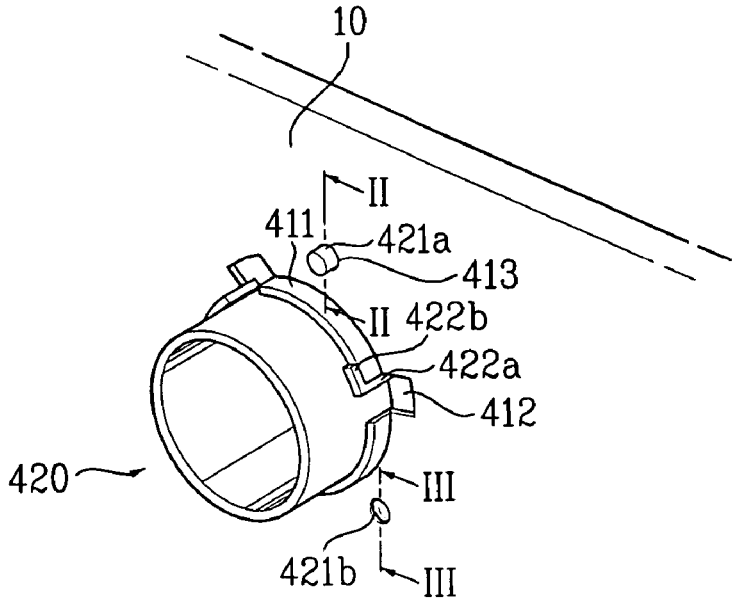

Referring to FIGS. 16A to 16C, a rib 411 for guiding the extension pipe 420 is formed along the circumference of the penetration hole 410. A flange 421 is formed on the outer circumferential surface of the extension pipe 410, and is in contact with the housing 10 placed around the penetration hole 410 so as to support the extension pipe 420. Also, the penetration hole 410 includes at least one cutout portion 412 formed in the rib 412. The cutout portion 412 is extended by a predetermined length to the housing 10 located around the penetration hole 410. At least one hook 422 is formed on the outer circumferential surface of the extension pipe 420. The hook 422 consists of two ribs that are normal to and connected with each other, and it has an angle shape substantially. In more detail, the hook 422 includes a first member 422*a* extended along the length direction of the extension pipe 420, and a second member 422*b* extended perpendicularly to the first member 422*a*. When the extension pipe 420 is coupled with the penetration hole 410, the hook 422 is inserted through the cutout portion 412 and latched to the rib 411.

Around the penetration hole 410, there are formed a plurality of auxiliary penetration holes 413. A plurality of protrusions 421*a*, 421*b* which are inserted into the auxiliary penetration holes 412 are formed on the flange 421. The protrusions include a cylindrical protrusion 421*a* and a hemispherical protrusion 421*b*, and they are formed at a predetermined interval. Also, a cutout groove 421*c* having a predetermined length is formed in the flange around the protrusions 421*a*, 421*b*, and permits the protrusions 421*a*, 421*b* to be elastically connected. In other words, as shown in the drawings, a kind of leg connecting the protrusions 421*a*, 421*b* with the flange 421 is formed by the cutout grooves 421*c*. The leg is elastically deformed such that the protrusions 421*a*, 421*b* are easily inserted into the auxiliary penetration holes 413.

Figure 17A:
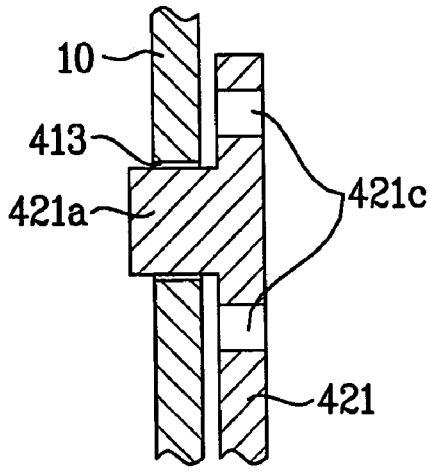
FIG. 17A is a partial sectional view taken along the line II-II of FIG. 16C.
Figure 17B:
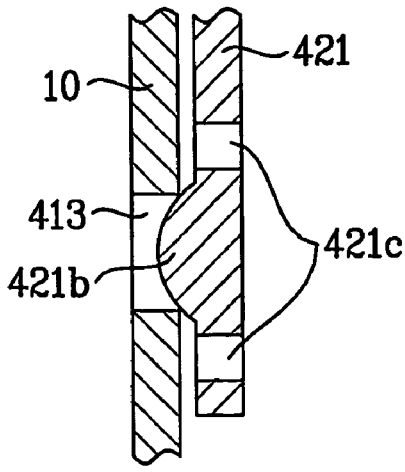
FIG. 17B is a partial sectional view taken along the line III-III of FIG. 16C.

In case the joint assembly 400 is coupled to the housing 10, as shown in FIGS. 16A and 16B, the extension pipe 420 is inserted into the penetration hole 410 while the hook 422 is inserted into the cutout portion 412. During the insertion of the extension pipe 420, the protrusions 421*a*, 421*b* are not inserted into the auxiliary penetration holes 413, and are pushed backward by the elastic deformation of the leg with being in contact with the housing 10. After that, as shown in FIG. 16C, by rotating the extension pipe 420, the hook 422 is engaged with the rib 411. In more detail, the first member 422*a* of the hook 422 is latched to a side portion of the rib 411 to thereby determine the coupling position of the extension pipe 420. The second member 422*b* is latched to an end of the rib 411 to prevent the separation of the extension pipe 420. Also, the protrusions 421*a*, 421*b* pushed backward during the rotation of the extension pipe 420 permit the extension pipe 420 to rotate smoothly. If the protrusions 421*a*, 421*b* reach the corresponding auxiliary penetration holes 413, the protrusions 421*a*, 421*b* are restored and inserted into the auxiliary penetration holes 413. As shown in FIG. 17A, the cylindrical protrusion 421*a* is firmly fixed to the housing 10 so as not to rotate the extension pipe 420 arbitrarily. Also, as shown in FIG. 17B, the hemispherical protrusion 421*b* separates the flange 421 from the housing 10 to thereby prevent the vibration of the washing machine from being transferred to the flange 421 during its operation. Accordingly, the pipes 21*b*, 22*b* are not separated from the extension pipe 420 by the vibration of the washing machine.

By the aforementioned coupling structure, the joint assembly 400 can prevent leakage of bubbles and be coupled firmly to the housing 10 without a coupling member.

Hereinafter, operation of the washing machine according to the present invention will be described in detail with reference to the accompanying drawings.

First, after putting laundry in the drum 30 using the door 11, a user instructs to wash the laundry using the control panel 12. According to the user's instruction, washing water is fed into the tub 20 along with detergent from an external water supply point via the inlet pipe 21*b*, the detergent box 21*c* and the inlet opening 21. Here, in the valve assemblies according to the respective embodiments, the valves 110, 210, 310 are placed on the extending portions 121, 221 of the ribs 120, 220, 320 or the hub 321, and the washing water and the detergent flow between the valves 110, 210, 310 and the inlet opening 21/the extension pipe 21*a* and are then fed into the tub 20. Similarly, although a child enters the drum 30, air introduced into the ventilation pipe 21*b* can be fed into the tub 20 and the drum 30 through a space between the valves 110, 210, 310 and the ventilation opening 22/the extension pipe 22*a* such that the child can breathe. The washing water and the detergent stored in the tub 20 are introduced into the drum 30 through the penetration hole 30*a* and are absorbed in the laundry.

After the water feeding step for a predetermined time interval, the drum 30 is rotated by the drive part 40 to start the washing. By the rotation of the drum 30, the detergent, the washing water and the laundry are mixed, so that bubbles are generated from the detergent. During the washing step, the bubbles are continuously increased and the tub 20 is filled with the bubbles. The bubbles ascend into the extension pipes 21*a*, 22*a* to elevate the valves 110, 210, 310.

In the first and second embodiments of the valve assemblies 100, 200, as shown in FIGS. 2B and 7B, the valves 110, 210 ascend with being subject to a buoyancy from the bubbles, and precisely close the pipes 21*b*, 22*b* with being guided by the guides 120, 220. Also, in the third embodiment of the valve assembly 300, as shown in FIG. 11B, the floating body 311 of the valve ascends while being subject to buoyancy, and the axial part 312 is guided by the hub 321 of the guide. The floating body 311 of the valve continues to ascend and closes the pipes 21*b*, 22*b*.

Accordingly, the bubbles are blocked so as not to be leaked to the outside along the pipes 21*b*, 22*b*. While the openings 21, 22 and the extension pipes 21*a*, 22*a* are filled with the bubbles, the valves 110, 210, 310 continuously close the pipes 21*b*, 22*b* such that the bubbles are not leaked. Meanwhile, if the bubbles are generated too much, a little amount of the bubbles may be introduced into the pipes 21*b*, 22*b* from the valve assemblies 100, 200, 300. However, since the bubble is a little amount, it can be completely blocked by the inner barrier rib 420*a* of the joint assembly.

After an elapse of a predetermined time, the bubbles disappear gradually and the weight of the valve becomes larger than the buoyancy due to the bubbles, so that the valve descends. In the cases of the first and second embodiments, as shown in FIGS. 2A and 7A, the valves 110, 210 descend with being again guided by the guides 120, 220, and are mounted on the extending portions 121, 221 of the guides. Also, in the case of the third embodiment, as shown in FIG. 11A, the floating body 311 of the valve is mounted on the hub 321 while the axial part 312 is again guided by the hub 321. Accordingly, the pipes 21*b*, 22*b* are opened such that washing water or external air is smoothly introduced.

As described above, the valve assemblies 100, 200, 300 close the pipes 21*b*, 22*b* whenever the drum 30 and the tub 20 are filled with the bubbles, and open the pipes 21*b*, 22*b* when the bubbles are removed. In other words, the valve assemblies 100, 200, 300 selectively close the pipes 21*b*, 22*b* such that the bubbles are not leaked. The joint assembly 400 assists the valve assemblies 100, 200, 300 and functions to finally close the pipes 21*b*, 22*b* such that the bubbles are not leaked.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

INDUSTRIAL APPLICABILITY

The washing machine according to the present invention has a valve assembly for closing the pipe connected to the tub. The valve assembly prevents bubbles from being leaked to the outside. A joint assembly which is additively installed in the washing machine of the present invention prevents leakage of the bubbles completely along with the valve assembly. Accordingly, the washing machine of the present invention is not contaminated by the leaked bubbles.

In addition, as aforementioned above, it is requested that detergents having different bubble amounts be used depending on the types (front loading or top loading) of the washing machine. However, since the washing machine of the present invention blocks the leakage of the bubbles to the outside, even the detergent having a much bubble generation amount can be used for the washing of laundry. In other words, the washing machine of the present invention can use detergent freely regardless of the bubble generation amount. Accordingly, since a user has no need of selecting detergent depending on the types of the washing machine, the washing machine of the present invention provides the user with convenience.

What is claimed is:

1. A washing machine comprising:

a housing;

a tub installed inside the housing, for storing washing water, the tub including at least one opening and at least one pipe connected with the opening;

a drum installed inside the tub and configured to wash laundry;

an extension pipe coupled with the pipe; and a valve assembly that selectively opens and closes the pipe, the valve assembly includes:

a valve configured to move in response to bubbles generated in the drum and the tub; and a guide configured to guide the movement of the valve, wherein the valve assembly is provided in the opening of the tub and in the extension pipe.

2. The washing machine of claim 1, wherein the opening is an inlet opening for feeding washing water from an external water feed source within the tub and the pipe is an inlet pipe connected with the inlet opening.

3. The washing machine of claim 2, wherein the opening is a ventilation opening for inflowing external air into the tub and the pipe is a ventilation pipe connected with the ventilation opening.

4. The washing machine of claim 1, wherein the valve is smaller than the opening and is larger than the diameter of the pipe.

5. The washing machine of claim 1, wherein the pipe has a diameter that is partially reduced adjacent to the opening such that the pipe is firmly closed by the valve.

6. The washing machine of claim 5, wherein the pipe has a rib inwardly extended from an inner circumferential surface thereof.

7. The washing machine of claim 5, wherein the pipe is a corrugated tube or a bellows tube having a plurality of corrugations.

8. The washing machine of claim 1, wherein the valve is a floating body with a predetermined size.

9. The washing machine of claim 8, wherein the floating body has a circular section.

10. The washing machine of claim 8, wherein the guide is a plurality of ribs extended from the inner circumferential surface of the opening by a predetermined length.

11. The washing machine of claim 10, wherein the rib is extended to have a predetermined interval from the valve.

12. The washing machine of claim 10, wherein the rib has an extending portion extended from an end thereof, for supporting the valve.

13. The washing machine of claim 1, wherein the valve comprises:

a floating body with a predetermined size; and an elastic member enclosing the floating body.

14. The washing machine of claim 13, wherein the guide is a plurality of ribs extended from an inner circumferential surface of the opening by a predetermined length.

15. The washing machine of claim 14, wherein the respective ribs are extended to have a predetermined interval from the valve.

16. The washing machine of claim 14, wherein the respective ribs have an extending portion extended from an end thereof, for supporting a lower portion of the valve.

17. The washing machine of claim 16, wherein the valve further comprises an extending portion extending from a lower portion of the floating body and inserted between the extending portions of the respective ribs.

18. The washing machine of claim 17, wherein an interval between the valve and the rib is greater than an interval between the extending portion of the valve and a stepped portion of the rib.

19. The washing machine of claim 13, wherein the floating body is made of Styrofoam and the elastic member is made of rubber.

20. The washing machine of claim 13, wherein the floating body has a circular section.

21. The washing machine of claim 20, wherein the valve has a beveled upper surface.

22. The washing machine of claim 21, wherein the valve is a conic type.

23. The washing machine of claim 1, wherein the valve comprises:

a floating body having a convex surface; and an axial part extending from a lower portion of the floating body so as to be guided by the guide.

24. The washing machine of claim 23, wherein the floating body is a hemispherical cell.

25. The washing machine of claim 23, wherein the floating body further comprises a flange horizontally extended from an edge thereof.

26. The washing machine of claim 23, wherein the axial part is a hollow shaft.

27. The washing machine of claim 23, wherein the axial part comprises an outer circumferential surface covered with an elastic material layer.

28. The washing machine of claim 27, wherein the rib has a length which is constant at a location adjacent to the inner circumferential surface of the opening and increases at a location adjacent to the outer circumferential surface of the hub.

29. The washing machine of claim 23, wherein the guide comprises:

a hub movably accommodating the axial part and supporting a lower portion of the floating body; and a plurality of ribs extended between an outer circumferential surface of the hub and an inner circumferential surface of the opening.

30. The washing machine of claim 23, wherein the valve further comprises an elastic member provided on an outer circumferential surface of the axial part and positioned between the hub and the floating body.

31. The washing machine of claim 30, wherein the elastic member comprises a buffer protrusion formed at a lower end thereof.

32. The washing machine of claim 1, wherein the valve assembly further comprises a plate member installed at a lower portion of the valve, for partially closing the opening.

33. The washing machine of claim 32, wherein the plate member is a circular plate type.

34. The washing machine of claim 33, wherein the plate member has a size that is equal to or greater than the section of a lower portion of the valve.

35. The washing machine of claim 32, wherein the plate member further comprises:

at least one leg vertically extended from the lower surface thereof; and a hook formed at an end of the leg and fixed to a part of the guide.

36. The washing machine of claim 1, wherein the valve assembly further comprises a joint assembly for fixing the pipe to the housing and partially closing the pipe, wherein the joint assembly includes a penetration hole formed in the housing, and wherein the extension pipe includes a vertically extended inner barrier rib inserted into the penetration hole and coupled with the pipe.

37. The washing machine of claim 36, wherein the penetration hole comprises a rib vertically formed at a circumference thereof, and the extension pipe comprises a flange configured to be in contact with the housing.

38. The washing machine of claim 37, wherein the penetration hole further comprises at least one cutout portion, and the extension pipe further comprises at least one hook formed at a predetermined interval on an outer circumferential surface thereof and inserted into the cutout portion.

39. The washing machine of claim 38, wherein the extension pipe further comprises a plurality of protrusions formed on the flange, and a plurality of auxiliary penetration holes into which the plurality of protrusions are inserted are formed at a circumferential portion of the penetration hole.

40. The washing machine of claim 39, wherein the protrusions further comprise a cylindrical type protrusion or a hemispherical type protrusion.

41. The washing machine of claim 39, wherein the extension pipe further comprises a cutout groove formed around the protrusion and having a predetermined length such that the protrusion is elastically connected with the flange.

* * * * *